US010935335B2

(12) United States Patent
Miller et al.

(10) Patent No.: US 10,935,335 B2
(45) Date of Patent: Mar. 2, 2021

(54) GAS REGULATION SYSTEM

(71) Applicant: Adams Arms, LLC, Odessa, FL (US)

(72) Inventors: Paul Miller, Herndon, VA (US); Mark Lambert, Land 'O Lakes, FL (US); James Granger, Tarpon Springs, FL (US); Gregory Miller, New Port Richey, FL (US); Graysen Pollard, Clearwater, FL (US)

(73) Assignee: ADAMS ARMS, LLC, Odessa, FL (US)

( * ) Notice: Subject to any disclaimer, the term of this patent is extended or adjusted under 35 U.S.C. 154(b) by 0 days.

(21) Appl. No.: 16/269,186

(22) Filed: Feb. 6, 2019

(65) Prior Publication Data

US 2019/0242663 A1 Aug. 8, 2019

Related U.S. Application Data

(60) Provisional application No. 62/626,916, filed on Feb. 6, 2018.

(51) Int. Cl.
*F41A 5/28* (2006.01)

(52) U.S. Cl.
CPC ..... *F41A 5/28* (2013.01)

(58) Field of Classification Search
CPC ..... F41A 5/18; F41A 5/24; F41A 5/26; F41A 5/28
USPC ..... 89/191.01–193
See application file for complete search history.

(56) References Cited

U.S. PATENT DOCUMENTS

| | | | | |
|---|---|---|---|---|
| 1,083,872 A * | 1/1914 | Berthier | F41A 19/33 89/140 |
| 1,366,863 A * | 1/1921 | Berthier | F41A 3/32 89/193 |
| 1,802,816 A | 4/1931 | Holek | |
| 2,462,119 A * | 2/1949 | Moore | F41A 5/28 89/193 |
| 2,748,662 A | 6/1956 | Simpson | |
| 3,657,960 A * | 4/1972 | Badali | F41A 5/18 89/191.02 |
| 4,433,611 A * | 2/1984 | Baumann | F41A 5/26 89/193 |

(Continued)

FOREIGN PATENT DOCUMENTS

| | | |
|---|---|---|
| GB | 608354 A | 9/1948 |
| GB | 1128112 A | 9/1968 |

*Primary Examiner* — Jonathan C Weber
(74) *Attorney, Agent, or Firm* — Shumaker, Loop & Kendrick, LLP; Jeffrey B. Fabian

(57) ABSTRACT

A firearm gas piston system provides tool-less removal and adjustment of gas flow along a nonlinear gradient and directs exhaust discharge away from the operator. The system includes a gas block with gas channels for directing exhaust gas away from an operator and a gas plug bore configured to accommodate insertion of a gas plug. The gas plug can include an actuator for rotating the gas plug, a key that fits within a key notch and key channel inside the gas plug bore to secure the gas plug within the bore, and a regulator portion to control the flow of discharge gas from a firearm barrel. The regulator portion includes a passage with two opening segments that accept discharge gas from the barrel and direct the gas through another opening disposed in a regulator cutout and to a piston portion of the gas block.

14 Claims, 11 Drawing Sheets

(56) References Cited

U.S. PATENT DOCUMENTS

| | | | | |
|---|---|---|---|---|
| 6,347,569 | B1 * | 2/2002 | Butler | F41A 3/40 42/16 |
| 7,469,624 | B1 | 12/2008 | Adams | |
| 7,610,844 | B2 | 11/2009 | Kuczynko et al. | |
| 7,739,939 | B2 | 6/2010 | Adams | |
| 7,856,917 | B2 | 12/2010 | Noveske | |
| 7,891,284 | B1 | 2/2011 | Barrett | |
| 7,926,404 | B2 | 4/2011 | Brittingham | |
| 7,971,518 | B2 | 7/2011 | Adams | |
| 8,065,949 | B1 * | 11/2011 | Molinari | F41A 5/28 89/193 |
| 8,161,864 | B1 | 4/2012 | Vuksanovich | |
| 8,245,625 | B2 | 8/2012 | Winge | |
| 8,245,626 | B2 | 8/2012 | Langevin | |
| 8,393,259 | B2 | 3/2013 | Larue | |
| 8,528,458 | B2 | 9/2013 | Windauer | |
| 9,335,106 | B1 * | 5/2016 | Simon | F41A 5/28 |
| 2009/0229454 | A1 | 9/2009 | Fluhr et al. | |
| 2010/0186582 | A1 * | 7/2010 | Juarez | F41A 5/28 89/191.01 |
| 2010/0218671 | A1 | 9/2010 | Mayberry et al. | |
| 2010/0269682 | A1 * | 10/2010 | Vuksanovich | F41A 5/28 89/191.01 |
| 2010/0275770 | A1 * | 11/2010 | Noveske | F41A 5/28 89/193 |
| 2011/0023699 | A1 | 2/2011 | Barrett | |
| 2012/0167756 | A1 * | 7/2012 | Larue | F41A 21/28 89/193 |
| 2012/0167757 | A1 * | 7/2012 | Gomez | F41A 5/28 89/193 |
| 2013/0055883 | A1 | 3/2013 | Cassels | |
| 2013/0098235 | A1 | 4/2013 | Reinken | |

* cited by examiner

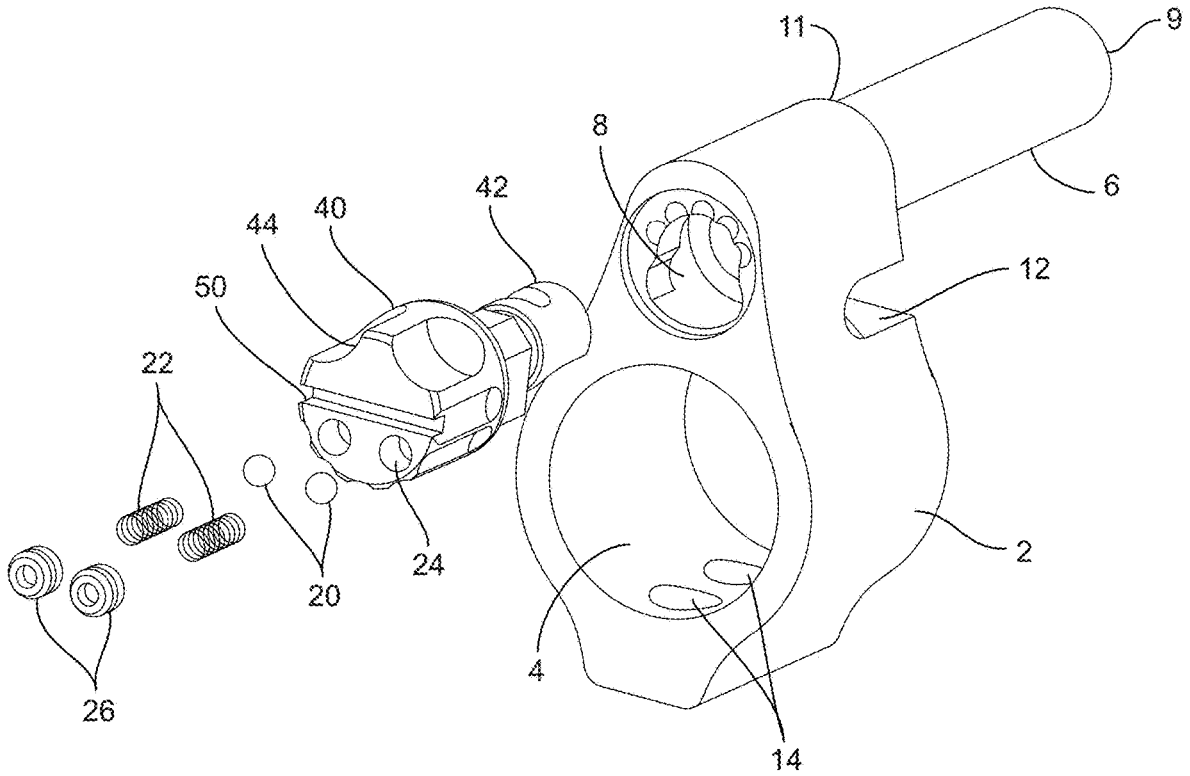
FIG. 2
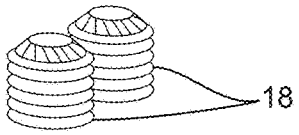

GAS REGULATION SYSTEM

REFERENCE TO RELATED APPLICATION

This application claims priority to U.S. Provisional Application No. 62/626,916 filed on Feb. 6, 2018 the entirety of which is incorporated herein by reference.

TECHNICAL FIELD AND BACKGROUND

The present invention relates generally to the field of semi-automatic and automatic firearms, and more particularly, to a system for operating the firearm and regulating the flow of discharge gas created by firing a round of ammunition.

Automatic firearms utilize the energy produced in discharging a round of ammunition to cycle a bolt-carrier assembly and load the next round. Direct-drive, piston gas-operated systems transfer the gas pressure developed behind a discharged round through a gas port in the barrel to a rod, which imparts the pressure to a bolt-carrier assembly. This system discharges exhaust gas in a muzzleward direction opposite the direction of the force exerted on the rod.

The force generated by the gas pressure should remain within a preselected range, and the bolt carrier action should be synchronized with the ejection of a cartridge for a discharged round. Inadequate pressure can result in the bolt action failing to fully cycle and chamber the next round. Excessive pressure on the other hand, can cause undue wear and damage that leads to unreliable firearm performance. Excessive pressure can also cause the system to run too "fast" where spent cartridges do not fully eject prior to the bold carrier cycling. Conversely, when inadequate pressure causes the firearm to run too "slow," the cartridges are not reliably cycled.

Many variables can affect the gas pressure and bolt carrier synchronization, including barrel rifling, ammunition weight, ammunition gun-powder content, firearm wear or damage, or the use of accessories, such as a sound suppressor. To account for these variables, it is desirable to utilize a means for precisely regulating the discharge gas flow. Existing designs for regulating gas flow utilize a small number of existing presets that adjust the gas flow along an approximately linear gradient that is not capable of an adequate range or number of increases or decreases in gas flow that are useful for accommodating some operational applications or conditions, such as the use of various types of ammunition or accessories.

Existing systems also suffer from the additional disadvantage that some of the exhaust gas is directed back towards the operator in the breechward direction after reflecting off components of the gas flow system, including the gas block. The discharge gas may act as an eye or skin irritant and could even present a long term health hazard as a result of heavy metals such a lead contained in the discharge gas.

Given the disadvantages of existing systems, it would be desirable to provide a firearm gas flow regulation system that is capable of a larger range of preset gas flow positions that also permits gas flow adjustment along a nonlinear gradient. It would also be desirable to provide a gas flow system capable of preventing discharge gas from being directed back towards the operator.

Accordingly, it is an object of the present invention to provide a firearm gas regulation system that allows nonlinear adjustment of discharge gas flow across a continuous range of preset positions while preventing the flow of discharge gas back towards the operator. It is a further object of the present invention to provide a gas flow regulation system that utilizes a low-profile gas block that can fit underneath an extended, uninterrupted hand guard to permit installation of firearm accessories, such as a Picatinny rail and scope.

SUMMARY

A first embodiment of the firearm gas regulation system includes a gas block having a breech end, a muzzle end, a first axis extending between the breech end and the muzzle end, an exterior surface, a barrel bore, a gas plug bore, and an aperture that places the barrel bore in fluid communication with the gas plug bore. The gas plug bore extends from a first opening at the muzzle end at least partially through an interior of the gas block along the first axis and terminates at an exhaust end. The gas plug bore is sized to accommodate a gas plug regulator portion inserted into the first opening where the gas plug regulator varies the gas flow coming from the barrel. The system also utilizes a gas plug that includes a first end, a second end opposite the first end, a second axis extending between the first end and the second end, an actuator at the first end, and a regulator portion at the second end. The regulator portion includes a passage that extends from a second opening to a third opening where the second opening includes a first segment having a first segment area and a second segment having a second segment area. When the regulator portion is inserted into the gas plug bore, the second opening is placed in fluid communication with the aperture. Varying the areas and geometries of the first and second segments in turn allows variation in the gas flow in a linear or nonlinear manner. The gas can be vented through a piston portion that extends outward from the breech end of the gas block to engage a drive rod.

In another embodiment, the gas block can incorporate a one or more detents disposed on the exterior surface of the gas block proximal to the first opening. The gas plug includes a position selector residing in the actuator that is configured to engage the one or more detents when the regulator portion is inserted into the gas plug bore. The position selector and detents hold the actuator and gas plug in place as it is rotated through various gas flow settings.

In yet another embodiment, the gas plug further includes a gas plug key disposed between the regulator portion and the actuator that extends from an outer surface of the gas plug. The gas plug bore includes a plurality of cavities, including at least one cavity to house the gas plug key. More specifically, the gas plug bore includes a regulator housing cavity at the exhaust end that is sized to accommodate the regulator portion of the gas plug when the gas plug is inserted into the gas plug bore. The aperture to the barrel bore is disposed within the regulator housing cavity and placed in fluid communication with the second opening of the regulator portion to permit the venting of the discharge gas from the barrel bore. The gas plug bore also includes a key notch at the muzzle end that partially defines the first opening, and the key notch is sized to accommodate the gas plug key when the gas plug key is inserted into the key notch at a first orientation. The gas plug key is sized and shaped such that the key cannot rotate within the key notch. This is accomplished by, for instance, making the dimension of the key notch slightly larger than the dimensions of the gas plug key. In this embodiment, the gas plug bore also has a key channel cavity disposed between the key notch and the regulator housing cavity to house the gas plug key. The key channel cavity is sized permit the gas plug key to rotate at least partially about the first axis when the gas plug key is inserted into the first opening and through the key notch. The key channel cavity generally has a larger cross sectional area relative to the first axis than the cross sectional area of the key notch. In this manner, the gas plug key abuts the interior surface of the key notch so that the gas plug key does not translate out of the gas plug bore.

In another aspect of the invention, the gas plug can include an annular ring disposed about the circumference of the gas plug between the actuator and the key. The ring can help avoid the formation of fillet edges on the gas plug that inhibit rotation of the gas plug in the gas plug bore as the gas flow is adjusted. The gas plug regulator portion can also include a cutout surrounding the third opening. Gas enters the second opening from the aperture, flows through the passage out of the third opening, and can then be vented from the third opening in the gas plug regulator through a gas piston connected to the gas block.

In one embodiment, the detents are formed within a counter-bore surrounding the first opening in the gas block. The actuator has a circumferential step formed on the side of the actuator that engages the gas block, and the step is sized to be received within the counter-bore when the regulator portion of the gas plug is inserted into the gas plug bore.

The system can include a second position selector disposed within in the actuator and configured to engage the one or more detents when the regulator portion is inserted into the gas plug bore. The first and second position selector can be housed within position selector bores formed with in the actuator portion. The position selectors can be biased by, for instance, springs within the position selector bores that urge the position selectors toward the exhaust end along the second axis to engage the detents and surrounding area of the gas block.

The gas block exterior surface can include at least one channel extending along the first axis from the breech end toward the muzzle end to vent discharge gas away from an operator. The discharge gas is vented away after exiting a piston portion extending from the breech end of the gas block along the first axis, where the piston portion includes an internal channel in fluid communication with the gas plug bore

BRIEF DESCRIPTION OF THE DRAWINGS

Features, aspects, and advantages of the present invention are better understood when the following detailed description of the invention is read with reference to the accompanying drawings, in which:

FIG. 2 is an exploded view of a gas flow regulation system according to one embodiment of the invention.

DETAILED DESCRIPTION

Figure 1:
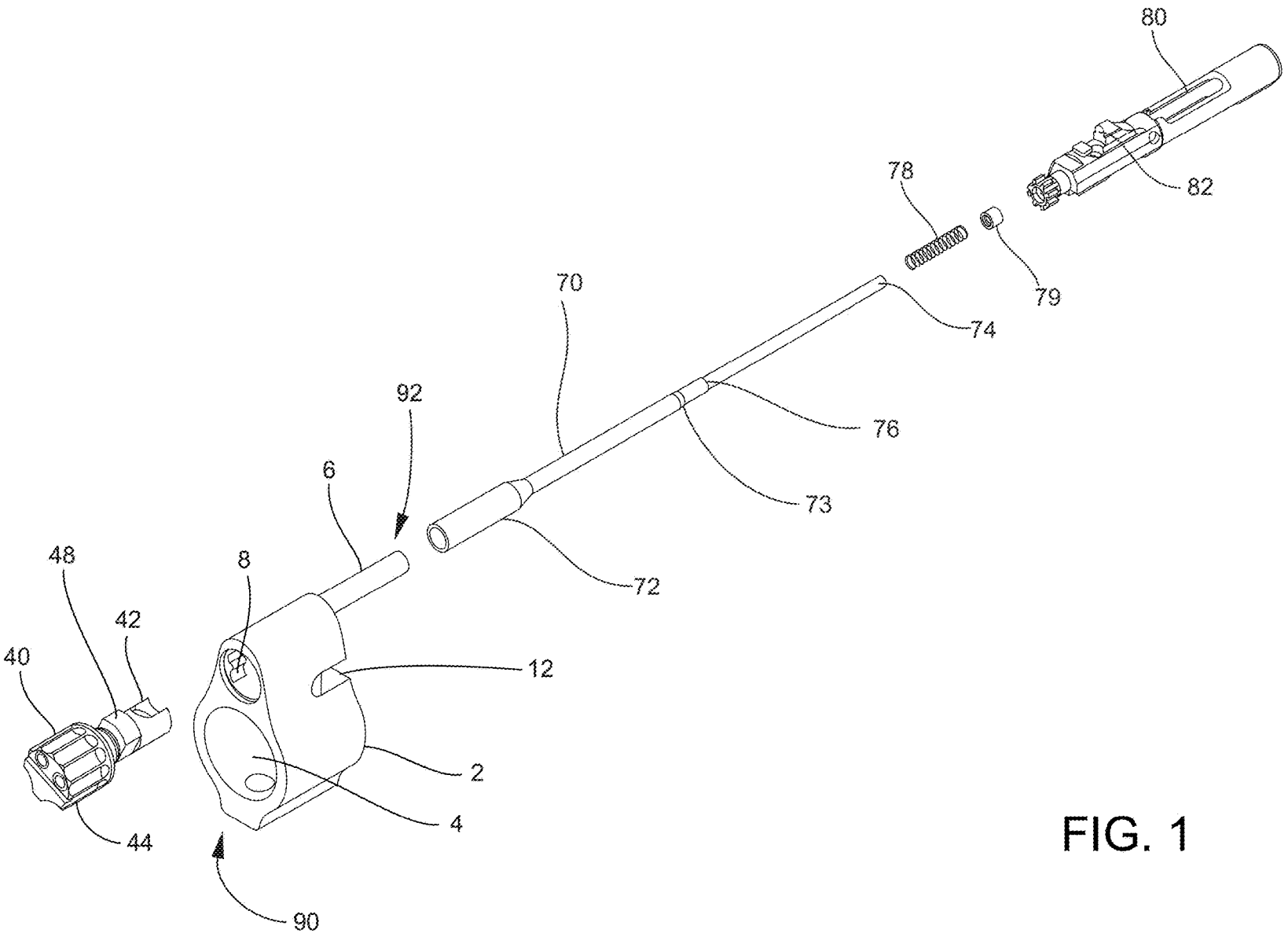
FIG. 1 is an exploded view of a gas flow regulation system and bolt-carrier assembly according to one embodiment of the invention.

The present invention will now be described more fully hereinafter with reference to the accompanying figures in which exemplary embodiments of the invention are shown. However, the invention may be embodied in many different forms and should not be construed as limited to the representative embodiments set forth herein. The exemplary embodiments are provided so that this disclosure will be both thorough and complete and will fully convey the scope of the invention and enable one of ordinary skill in the art to make, use, and practice the invention.

Relative terms such as lower or bottom; upper or top; upward, outward, or downward; forward or backward; and vertical or horizontal may be used herein to describe one element's relationship to another element illustrated in the figures. It will be understood that relative terms are intended to encompass different orientations in addition to the orientation depicted in the drawings. By way of example, if a component in the drawings is turned over, elements described as being on the "bottom" of the other elements would then be oriented on "top" of the other elements. Relative terminology, such as "substantially" or "about," describe the specified materials, steps, parameters, or ranges as well as those that do not materially affect the basic and novel characteristics of the claimed inventions as whole (as would be appreciated by one of ordinary skill in the art).

Disclosed herein is a firearm gas regulation system that enables convenient, flexible adjustment of discharge gas flow along a nonlinear gradient using a low-profile, compact gas block that directs exhaust gas discharge away from the operator. As shown in FIG. 1, a system according to one embodiment of the present invention generally includes: a gas block 2 with a barrel bore 4, a gas plug bore 8, and a piston portion 6; a gas plug 40 with an actuator 44, a key 48, and a gas regulator 42 configured for releasable insertion into the gas plug bore 8; and a drive rod 70, a drive rod spring 78, a bushing 79, and a bolt carrier assembly 80. The gas plug 40 can be rotated within the gas plug bore 8 using the actuator 44 and locked into a plurality of preset gas positions. The gas regulator 42 controls the flow of discharge gas from the barrel as the gas plug 40 rotates within the gas plug bore 8. The gas block 2 includes gas channels 12 that direct discharge gas away from an operator after it is discharged from the gas portion 6 of the gas block and through the sleeve at the muzzle end 72 of the drive rod 70.

Figure 3:
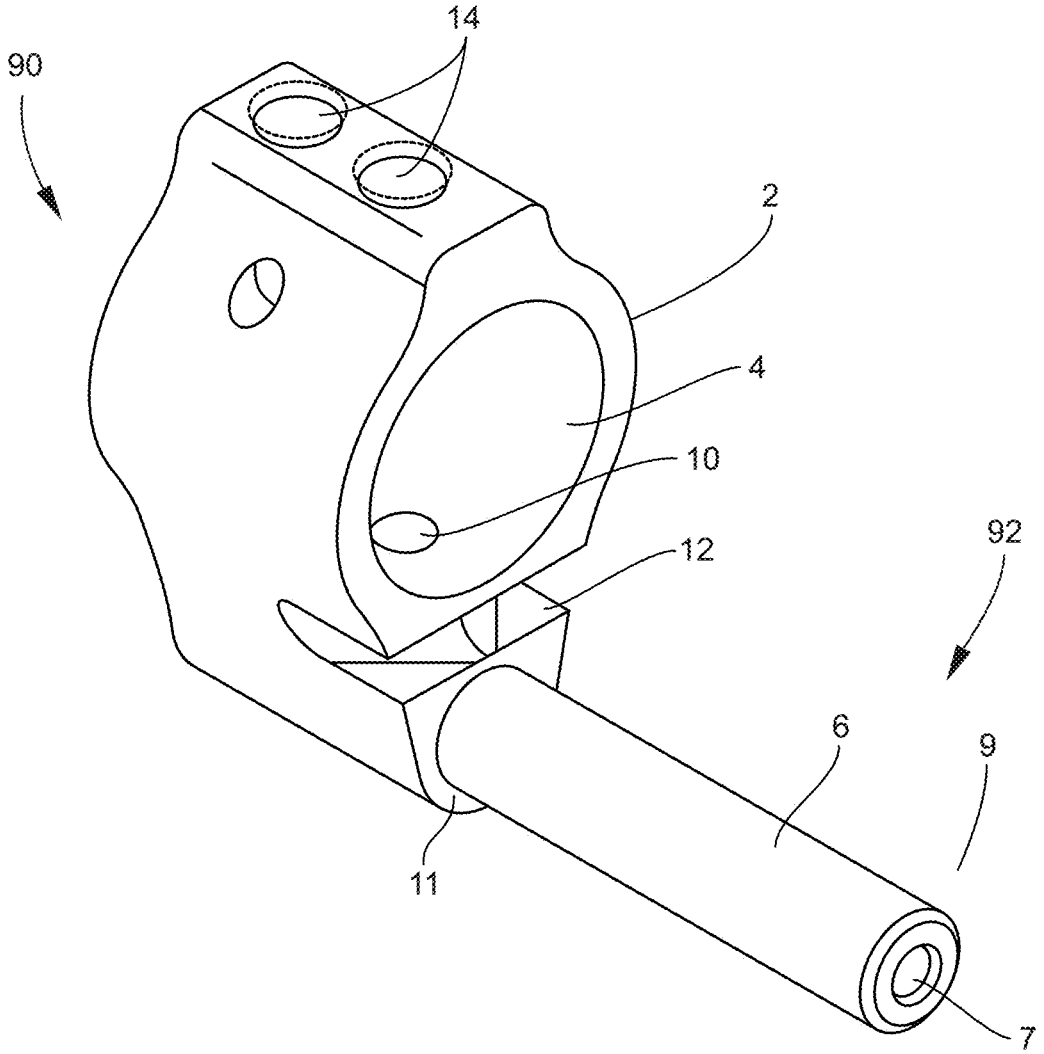
FIG. 3 is a perspective, bottom view of a gas block according to one embodiment of the invention.
Figure 4:
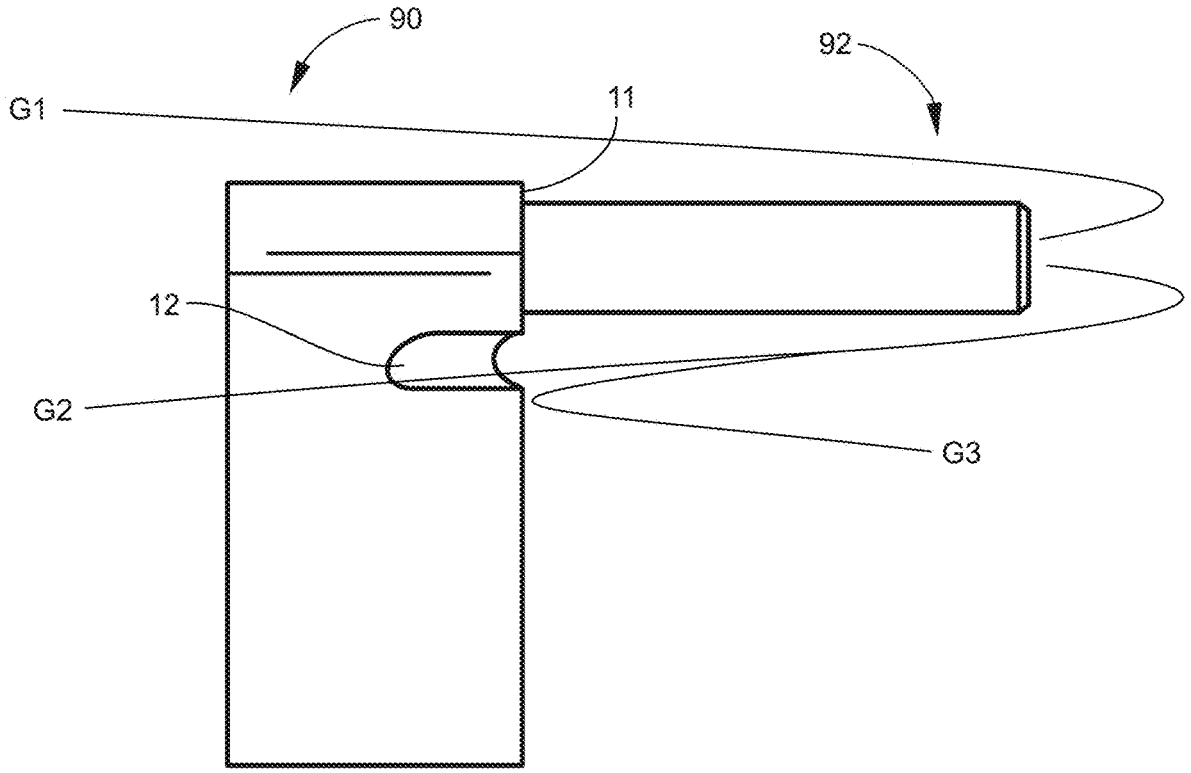
FIG. 4 is a side view of a gas block according to one embodiment of the invention.

Looking at the details of the gas block 2 embodiment shown in FIGS. 2 through 4, the barrel bore 4 extends through the gas block 2 from the muzzle end 90 to the breach end 92 and is configured to receive the barrel of a rifle. The gas block 2 can be secured to the barrel using bolts, screws, or any other suitable fastening means. The barrel bore 4 of the gas block 2 depicted in FIGS. 2 & 3 contains tapped holes 14 to receive fasteners 18. An aperture 10 formed between the barrel bore 4 and the gas plug bore 8 places the rifle barrel in fluid communication with the gas plug bore 8. The aperture 10 is aligned with a gas port in the barrel and receives the discharge gas created by firing a round of ammunition. The discharge gas is directed to the gas plug bore 8 through the gas port and aperture 10 where it is regulated by the gas plug 40.

The gas plug bore 8 extends from the muzzle end 90 of the gas block 2 to the piston portion 6 on the breech end 92. The piston portion 6 is generally cylindrical and extends outward from, the breech end 92 of the gas plug bore 8. The piston portion 6 contains an internal exhaust channel 7 in fluid communication with the gas plug bore 8. The internal channel 7 terminates at an exhaust outlet 9. The outer diameter of the piston portion 6 is smaller than the inner diameter of the muzzle end 72 of the drive rod 70 and smaller than the outer diameter of the gas block portion that defines the gas plug bore 8 to create an annular surface 11 that seats a muzzle end 72 of the drive rod 70.

The piston portion 6 may be a separate piece, or it may be of unitary construction with the gas block 2 or of unitary construction with the gas plug 40. Preferably, the piston portion 6 is a unitary piece with the gas block 2 so that less surface area is needed within the gas block 2 to hold the piston portion 6 in place. This allows the dimensions of the gas block 2 to be reduced, which allows the firearm to accommodate a larger variety of rails for mounting accessories. A smaller gas block 2 also helps to limit the amount of discharge gas that is reflected back to an operator as the discharge gas can more easily flow through or around the smaller structural features of the gas block 2 without reflecting off the gas block 2 and being directed back toward the operator.

The gas flow reflected off the gas block 2 back toward the operator can also be reduced through the formation of gas channels 12 in the gas block, as illustrated with reference to FIG. 4 depicting a simplified illustration of the exhaust gas flow from the piston portion 6. There, the low profile gas block results in a small annular surface 11 that permits a portion of the discharge gas G1 to exit the exhaust outlet 9, be directed through the sleeve 72 (not shown), and flow over the top of the gas block 2. A portion G2 of the discharge gas also flows through the gas channels 12 and is directed in the muzzleward direction while a smaller portion of the discharge gas G3 is reflected off the surface of the gas block 2 and directed back towards the operator. The gas flow toward the operator G3 can be minimized in part by sizing the channels 12 so as to occupy a larger portion of the annular surface 11 between the barrel bore 4 and the piston portion 6 on the breech end 92 of the gas block 2

Smaller gas block 2 dimensions are also promoted by forming the piston portion 6 as a separate piece from the gas plug 40, which departs from existing system that utilize a gas plug 40 and piston portion 6 formed as a single unit residing within the gas plug bore 8. The advantage of utilizing a gas plug 40 that is separate from the piston portion 6 is that the size of the gas plug 40 does not depend on the size of the piston portion 6 so that the piston portion 6 can be sized separately for coupling with the muzzle end 72 of the drive rod 70. This allows the diameter of the gas plug 40 and the gas plug bore 8 to be decreased relative to the size of the piston portion 6, thereby facilitating the use of low-profile gas blocks with a small annular surface dimension 11 that can fit underneath extended, uninterrupted hand guards and various types of mounting rails. A smaller gas plug 40 diameter also has the added benefit of limiting the seepage of discharge gas flow between the gas plug 40 and the gas plug bore 8 to mitigate the resulting buildup of carbon or other contaminants that can cause fouling or jamming. In one embodiment of the gas plug 40 shown in the attached figures, the gas plug 40 is formed with dimensions that are comparably smaller than existing gas plug or gas piston components, including a length of approximately one inch with an actuator 44 radius of less than one-half inch and a regulator 42 radius of approximately one-quarter inch.

Figure 5:
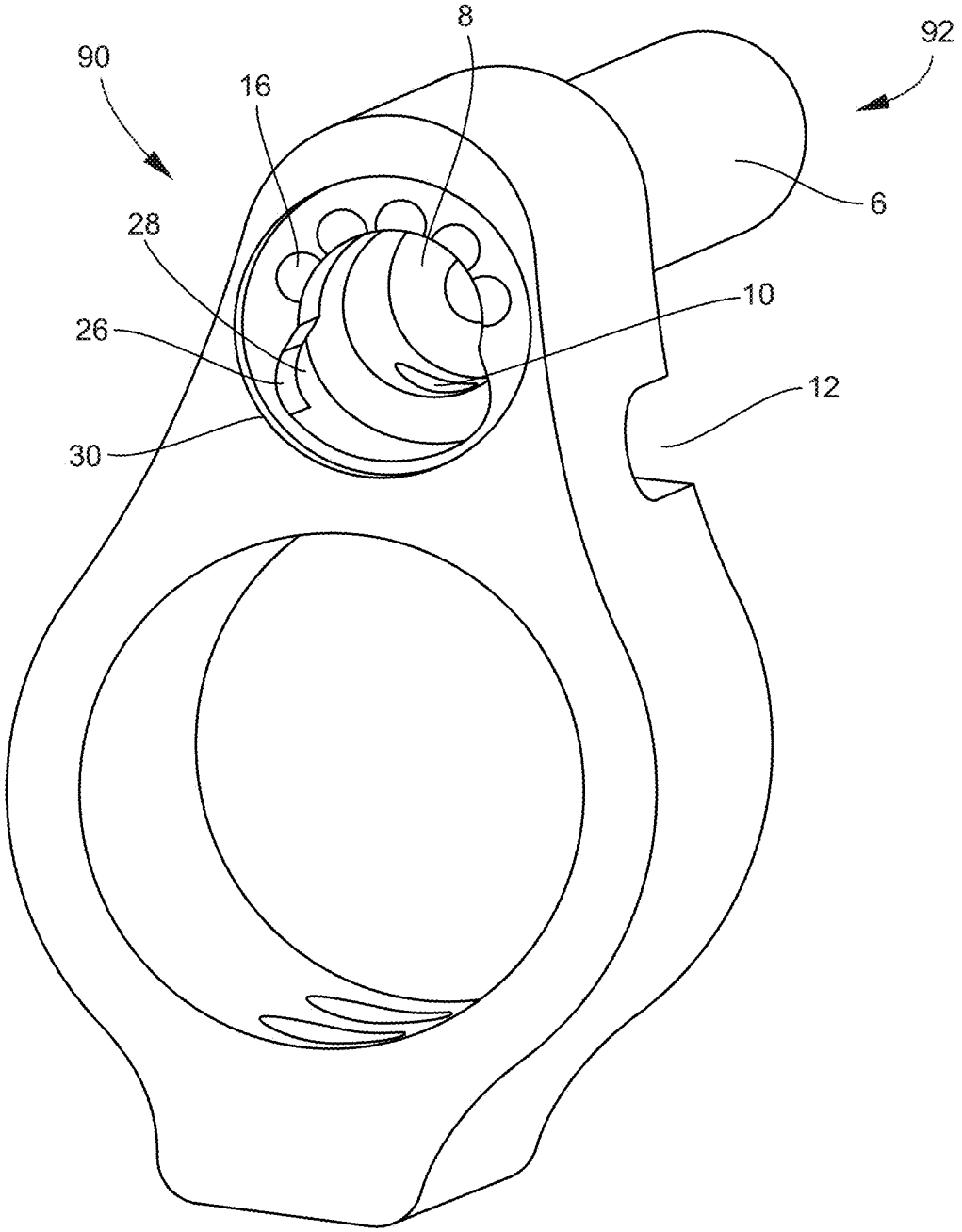
FIG. 5 is a rear, perspective view of a gas block according to one embodiment of the invention.
Figure 6:
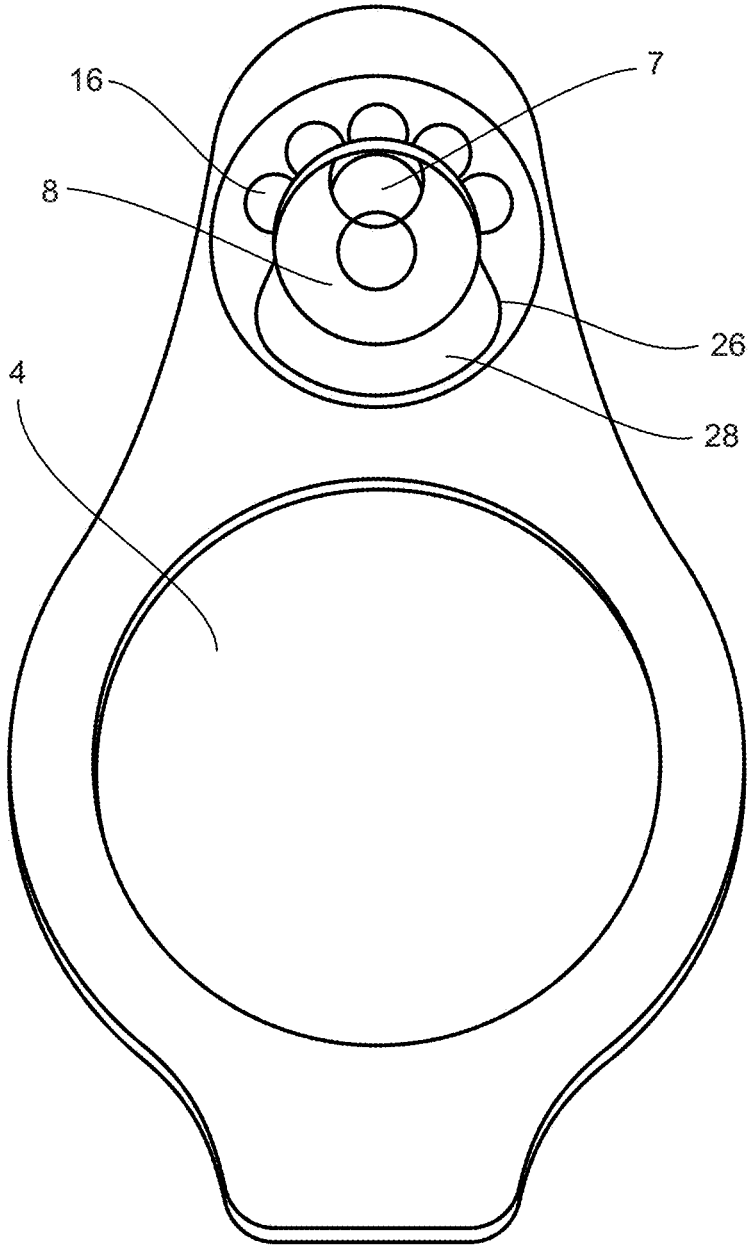
FIG. 6 is a rear view of a gas block according to one embodiment of the invention.
Figure 7:
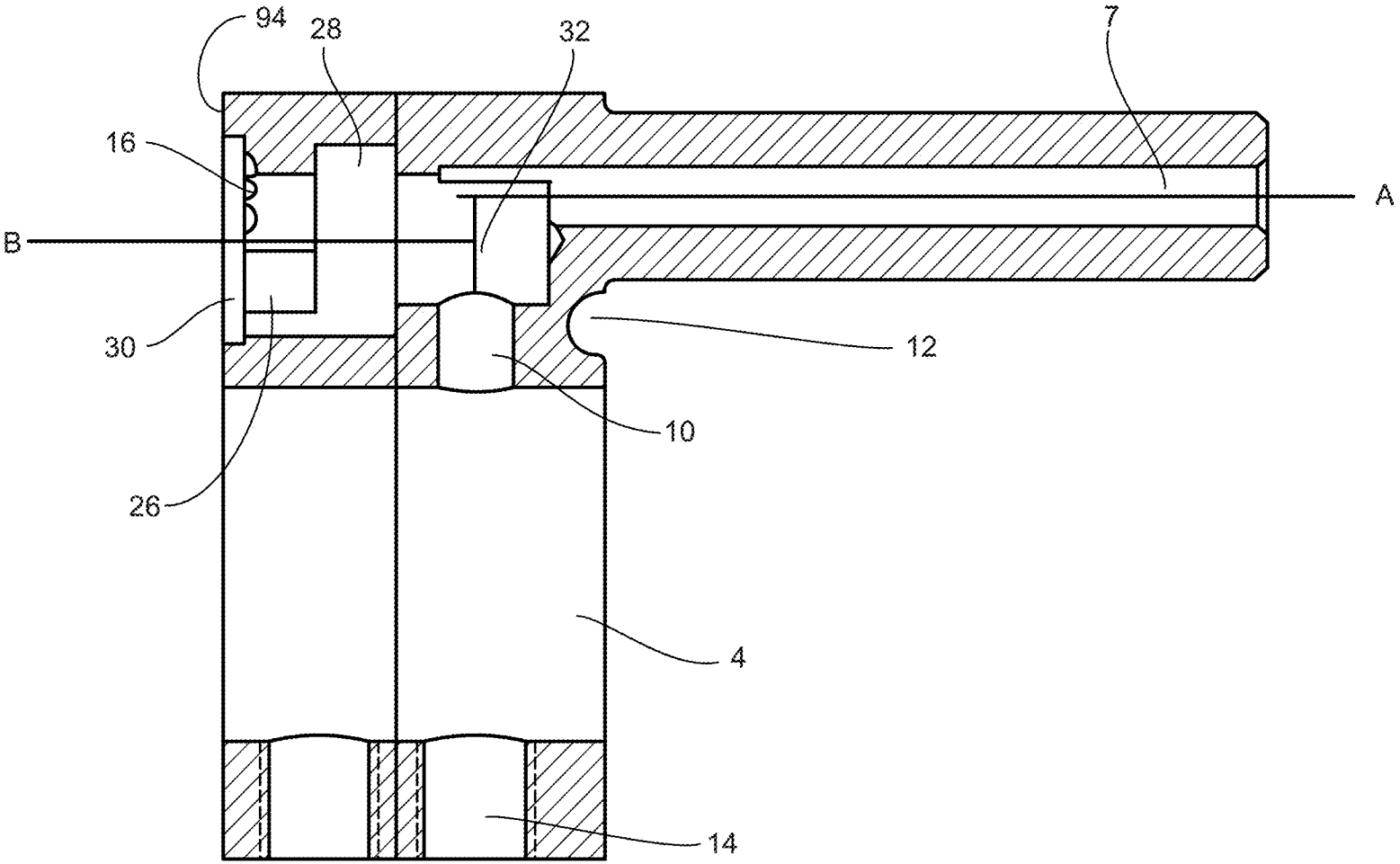
FIG. 7 is a side, cutaway view of a gas block according to one embodiment of the invention.

Turning to FIGS. 5-7, the muzzle end 90 of the gas block 2 includes one or more detents 16 configured to receive a position selector 20. The detents 16 shown in the attached figures are depicted as semicircular concavities, but other shapes could also be utilized, such as square, rectangular, or prolate shaped notches. The embodiment of the invention shown in FIGS. 5 & 6 contains five detents 16, but one skilled in the art will recognize that more or less detents 16 can be used, and the density of the detents 16 can be increased by making them smaller or by overlapping adjacent detents 16. The detents 16 shown in FIG. 6 are placed over an angular sweep of approximately 140 degrees, but the positioning and number of detents 16 can be varied to create a larger or smaller angular sweep. The precision of gas flow control depends in part on the location, arrangement, number, size, and density of the detents 16.

The muzzle end 90 of the gas block 2 also includes a counter-bore 30 configured to accommodate a step 47 on the actuator portion 44 of the gas plug 40 such that the step 47 is accepted within the counter-bore 30 while the outer surface of the actuator 44 abuts the outer surface of the gas block 2 when the gas plug 40 is inserted into the gas plug bore 8. The mating of the counter-bore 30 and step 47 helps to secure the gas plug 40 into the gas plug bore 8 by preventing radial translation of the gas plug 40 about the plane formed at the mating surface. The counter-bore 30 and step 47 also helps to militate against exhaust gas leakage from the gas plug bore 8 by creating an approximately perpendicular feature that blocks the path the exhaust gas might otherwise have in exiting the gas plug bore 8 during firearm operation.

In addition to the detents 16 and the step 47, the muzzle end 90 of the gas block 2 further includes a key notch 26 formed as a cutout feature sized to accommodate the key 48 of the gas plug 40. The key notch 26 and key 48 shown in the attached figures are approximately semi-cam or semi-lobe shaped where the arc formed by the outer circumference of the key 48 corresponds to the arc of the key channel 28 in the gas plug bore 8 so as to facilitate rotation of the gas plug 40 within the gas plug bore 8. However, skilled artisans will appreciate that other acceptable key 48 or key notch 26 shapes can be used.

The key 48 and corresponding key channel 28 form a gas plug lock that secures the gas plug 40 into the gas plug bore 8. As depicted in FIG. 7, the gas plug bore 8 includes the key channel 28 sized to accommodate the key 48 and a regulator housing 32 sized to accommodate the gas plug regulator 42. The key 48 and key channel 28 are used to secure the gas plug 40 into the gas plug bore 8, and frictional contact between the key 48 and key channel 28 prevents lateral translation of the gas plug 40 out of the gas plug bore 8 during firearm operation.

The gas plug 40 is secured into the gas plug bore 8 by first aligning the key 48 and the key notch 26 and the gas regulator 42 with the opening of the regulator housing 32 before inserting the gas plug 40 into the gas plug bore 8 until the actuator 44 frictionally engages the outer surface of the gas block 2 surrounding the counter-bore 30. The gas plug 40 is locked into place by turning the actuator 44 to rotate the key 48 within the key channel 28 so that the key 48 is no longer aligned with the key notch 26. Rotating the gas plug 40 additionally causes the biased position selectors 20 to engage the detents 16, thereby further locking the gas plug 40 into a gas flow position.

The embodiment of the gas plug lock shown in the attached figures has the particular advantage over existing locking means, such as threaded locking mechanisms, of improved prevention of discharge gas seepage from the gas plug bore 8 during firearm operation. However, the embodiment described herein is not intended to be limiting. One of ordinary skill in the art will recognize that other means for releasably securing the gas plug 40 in the gas plug bore 8 are available. For example, one embodiment may utilize one or more locking balls seated within an annular grove of gas plug 40 such that when the gas plug 40 is subject to a translational bias, the locking balls become unseated and extend beyond the outer surface of the gas plug to become lodged in an annular recess in the interior surface of the gas plug bore 8. Alternative regulator valve locks may include, for example, détente buttons and corresponding notches on the gas block 2 and gas plug 40, threading the gas plug 40 into the gas block 2, or utilizing loosenable screws threaded into the gas block 2 that immobilize the gas plug 40 at a given degree of rotation. If desired, the gas plug 40 can contain discrete depressions on its surface to accept the tip of an immobilizing screw, thereby allowing the operator to set the gas flow at preset positions.

Details of the gas plug 40 are depicted in FIGS. 2 & 8-10. The gas plug 40 includes a regulator 42, a ring 43, insets 45, a key 48, and an actuator 44. The ring 43 facilitates rotation of the gas plug 40 within the gas plug bore 8 and facilitates formation of the smaller gas plug features. Formation of the ring 43 with a larger diameter than the surrounding insets 45 obviates the need to form ninety degree (90°) machined cuts between features of the gas plug with varying dimension, which is difficult to achieve with smaller components and can result in fillet features that inhibit rotation.

The regulator 42 shown in the attached figures is approximately cylindrical and includes a first regulator opening 34 and a second regulator opening 35 and a gas passage 36 extending between the first opening 34 and the second opening 35. To permit gas flow discharge during operation, the first opening 34 or the second opening 35 is aligned in whole or in part with the aperture 10 in the gas bock to place the opening in fluid communication with the aperture 10. Exhaust gas flows through the aperture 10 to the gas passage 36 through the first 34 or second 35 opening before being directed through the internal channel 7.

In existing systems, the aperture to the barrel and the openings are generally circular, and the openings are formed on the outer sidewall surface of a gas plug or piston. The discharge gas flow is adjusted by controlling the diameter of the openings or the aperture and the extent of overlap between the aperture and openings. As the extent of the overlap between the aperture and opening changes, the gas flow increases or decreases in an approximately parabolic fashion with a linear gradient.

As compared to existing systems, the gas plug 40 embodiment shown in the attached figures provides substantially enhanced flexibility in controlling the discharge gas flow, and the changes in gas flow are not limited to adjustments along a linear gradient. Rather, the gas plug 40 allows for abrupt, nonlinear changes in gas flow between settings. This enhanced control over discharge gas flow allows operators to adapt to a wider range of conditions, such as the use of various types of ammunition or accessories. The enhanced gas flow control is achieved by varying not only the size of the openings, but also the cross-sectional shape of the openings, the orientation of the openings, the shape of the regulator itself, and the placement of the openings on the regulator.

Figure 8:
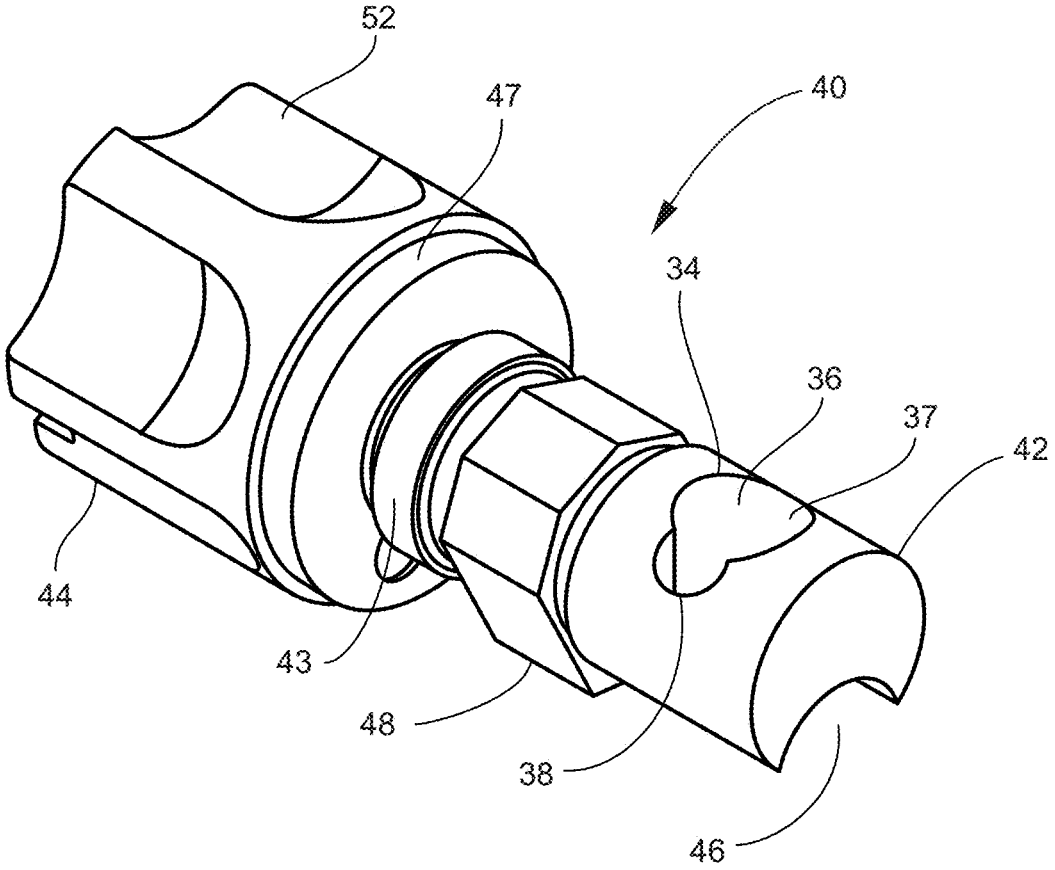
FIG. 8 is a front, perspective view of a gas plug according one embodiment of the invention.
Figure 9:
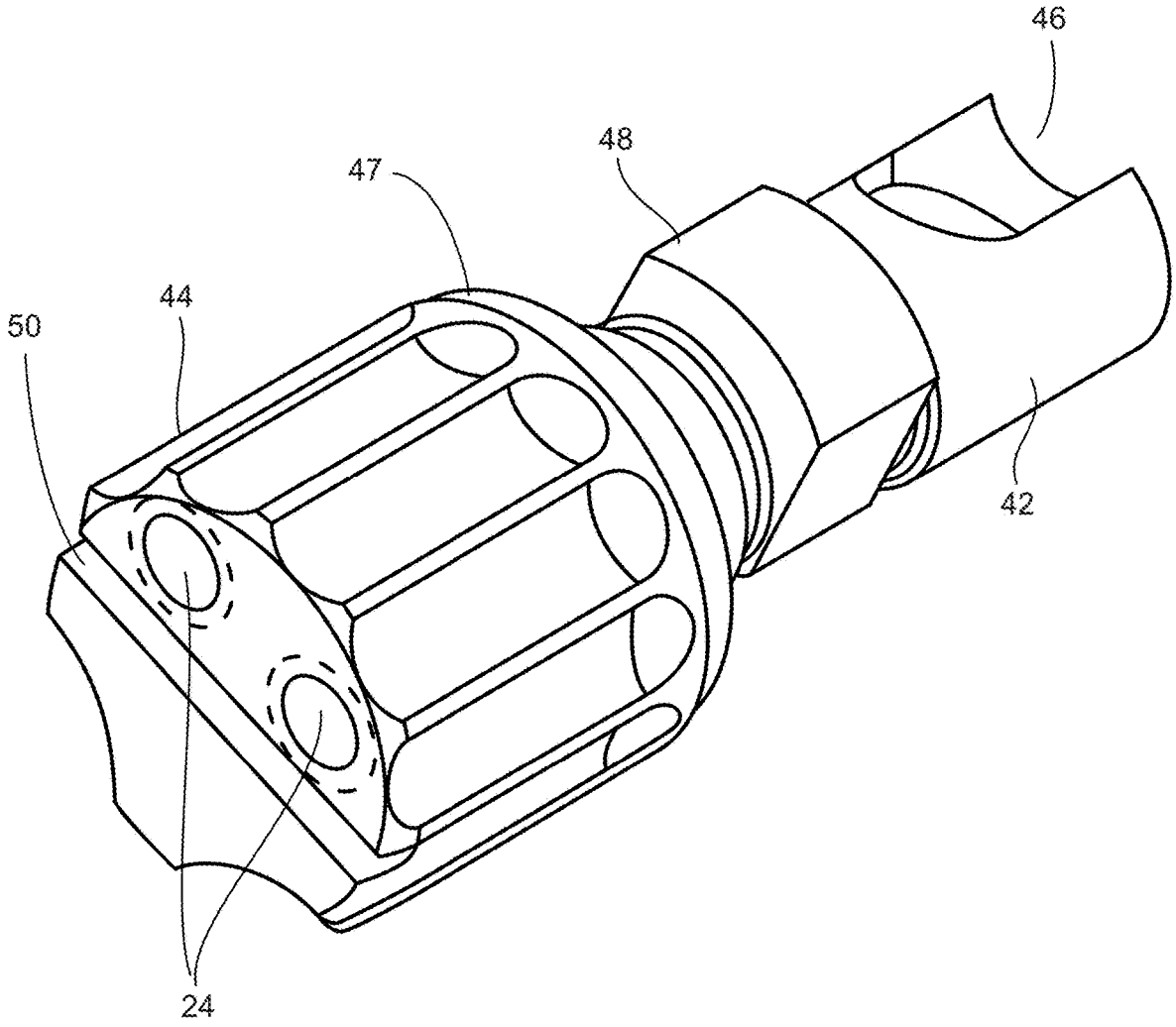
FIG. 9 is a rear, perspective view of a gas plug according one embodiment of the invention.
Figure 10:
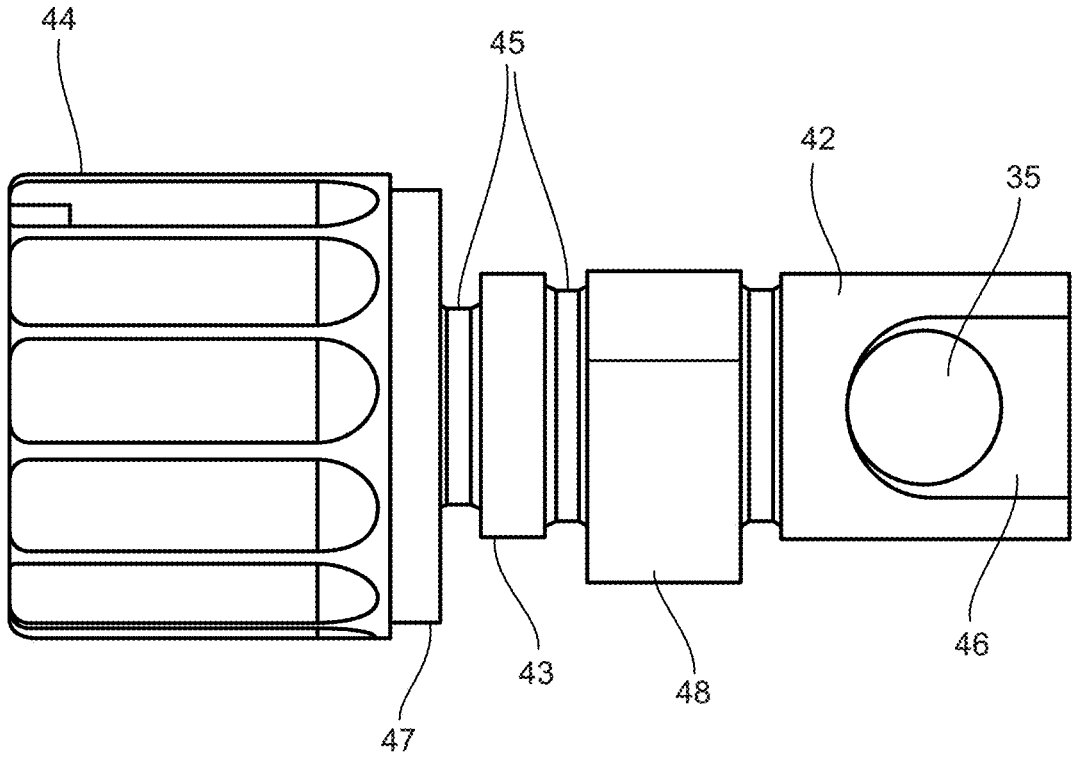
FIG. 10 is a bottom view of a gas plug according one embodiment of the invention.

By way of example, the first regulator opening 34 depicted in FIG. 8 is formed as a combination of two overlapping circular segments. The first circular segment 37 has approximately the same diameter as the aperture 10 and is formed by creating a circular bore perpendicular to the surface of the regulator 42. The second circular segment 38 has a smaller diameter than the first circular segment 37, and is formed by creating a bore at a non-perpendicular angle relative to the surface of the regulator. The discharge gas flow varies with the diameters of the two circular segments 37 & 38, the angle of formation for the circular segments relative to the surface of the regulator 42 (i.e., the angle at which the segments are drilled or bored, such as directly perpendicular to the surface or at an angle), and the amount of overlap between the two circular segments 37 & 38. The discharge gas flow can also be controlled by forming a cutout 46 in a portion of the regulator 42 in which the second opening 35 is disposed.

Adjustment of the gas flow according to the present invention can be better understood with the following simplified example. An operator may rotate the gas plug 40 shown in FIG. 8 within the gas bore 8 so that a portion of the second circular segment 38 is aligned with the aperture 10 in a first gas setting while the entire first circular segment 37 is covered by the regulator housing 32 sidewall. Continuing to rotate the gas plug 40 into a second position may increase the alignment or overlap between the second circular segment 38 and the aperture 10 while the first circular segment 37 remains covered by the regulator housing 32 interior sidewall. Rotating the gas plug 40 into the second gas flow position will result in a relatively small increase in gas flow along a linear gradient given the comparatively smaller diameter of the second circular segment 38. If the operator continues to rotate the gas plug 40 into a third position where the first circular segment 37 becomes at least partially aligned with the aperture 10, the overlap between the first regulator opening 34 and the aperture 10 will abruptly increase owing to the larger diameter of the first circular segment 37. This will in turn cause a sudden increase in the discharge gas flow along a nonlinear gradient.

One of ordinary skill in the art will recognize that the gas plug 40 embodiments described herein are not intended to be limiting, and other configurations may be used to customize the gas flow adjustment. For instance, the regulator openings 34 & 35 can be formed using other cross-sectional shapes, such as elliptical or cam-shaped, or the cutout 46 dimensions can be decreased to restrict gas flow or enlarged to increase gas flow. Additionally, the gas plug 40 is interchangeable so that operators have the ability to select a gas plug 40 tailored to a particular application.

The gas plug actuator 44 has fluted edges 52 or other grip features to facilitate gripping when rotating the gas plug 40 within the gas plug bore 8 or during installation and removal. The actuator 44 also includes an adjustor slot 50 on the outside face of the muzzle end. The adjustor slot 50 can accommodate a tool, such as a screw driver, that can be used to rotate the gas plug 40 if the gas plug 40 becomes difficult to rotate or if the gas plug 40 is not accessible by hand as a result of the installation of an accessory, such as a handguard.

In the embodiment shown in the attached figures, the actuator 44 is generally cylindrical, but other suitable shapes may be used, such as cam-shaped or squared. The actuator 44 has outer dimensions larger than the dimensions of the muzzle end of the gas plug bore 8 and key notch 26 such that when the gas plug 40 is fully inserted into the gas plug bore 8, the actuator 44 is adjacent to, or abuts, the outer surface of the gas block 2.

One or more position selectors 20 reside within position selector bores 24 extending through the actuator 44 or another portion of the gas plug 40. The position selectors 20 are biased with, for example, biasing springs 22 housed within the position selector bores 24. In the embodiment shown in FIG. 2, the position selectors 20 and biasing springs 22 are held in the position selector bores 24 with position selector screws 26. Alternatively, the position selector 20 may be secured within the position selector bores 24 using other means known to those skilled in the art, such as soldering or press fitting, or the position selectors 20 can be constructed as a unitary piece with the actuator 44.

As the gas plug 40 is rotated within the gas bore 8, one of the position selectors 20 engages a first detent 16 to lock the gas plug 40 into a first gas flow position. The second position selector 20 engages the gas block 2 outer surface between two detents, and as a result, the second position selector 20 is depressed into the position selector bore 24. As the gas plug 40 is rotated further, the second position selector 20 passes over the first detent 16, and the position selector spring 22 translates the second position selector 20 out of the position selector bore 24 to engage the first detent 16. The first position selector 20 then engages the gas block outer surface between detents 16 and is depressed within the position selector bore 24. In this manner, the gas plug 40 is locked into a second gas flow position.

The foregoing example is not intended to be limiting, and skilled artisans will appreciate that the system can operate to regulate gas flow using a single position selector 20 or a multitude of position selectors 20. Skilled artisans will further appreciate that the two position selector 20 configuration shown in FIG. 2 provides an advantage over a single position selector 20 configuration in that twice as many possible gas flow positions are available to the operator using the same number of detents 16. The capability of providing twice as many gas flow position without increasing the number of detents 16 permits more flexibility for an operator to control the gas flow without necessitating a larger gas block 2 to accommodate more detents 16. Use of smaller gas block dimensions has the advantages set forth above with regard to accommodating more accessories, limiting exhaust gas seepage, and limiting reflection of exhaust gas toward the operator. In one embodiment, the gas block 2 depicted in the attached figures is manufactured with a length of less than one inch (excluding the gas portion 6) as measured from the muzzle end 90 to the breech end 92, a total height of approximately 1.6 inches, and a height of approximately one-half inch as measured from the center of the channel 12 to the top of the gas block 2.

Smaller gas block features with increased flexibility in gas flow adjustment can also be achieved by creating an offset between the centerline of the gas plug bore 8 and the internal channel 7 of the piston portion 6, as shown in FIG. 7. The centerline of the gas plug bore 8 along line B is lower relative to the centerline of the internal channel 7 along line A.

Figure 11B:
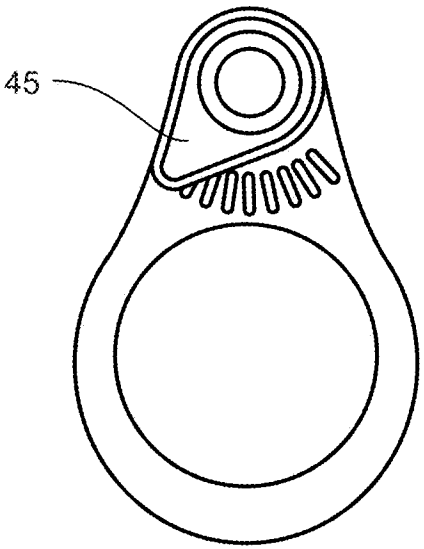
FIG. 11B illustrates a rear view of an alternative embodiment of the low-profile gas block and gas actuator.
Figure 11A:
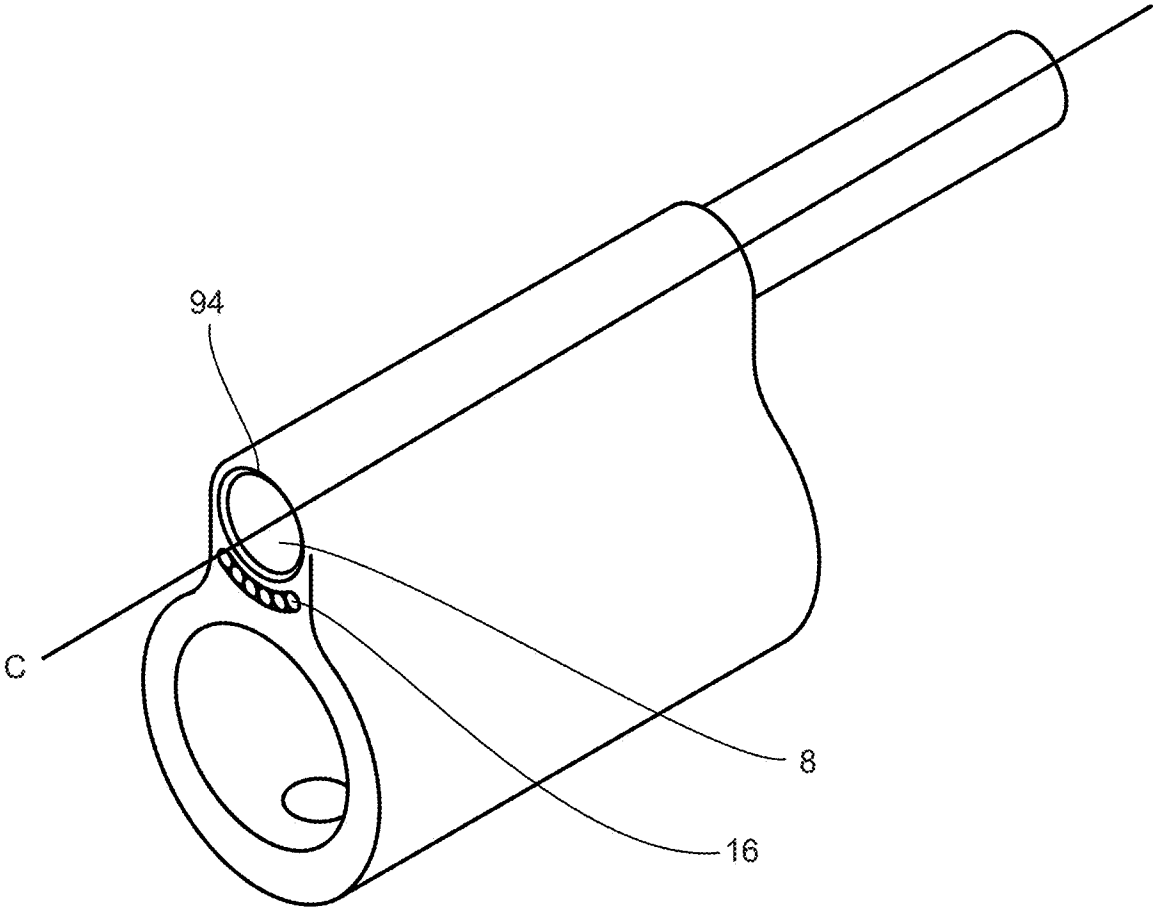
FIG. 11A illustrates a perspective view of an alternative embodiment of the low-profile gas block and gas actuator.

In some embodiments, as depicted in FIGS. 11A and 11B, use of a low-profile gas block 2 where the centerline C of the internal channel 7 and gas plug bore 8 are coaxially aligned results in a small surface area 94 on the muzzle end 90 of the gas block 2 above the gas block bore 8. The smaller surface area 94 is not sufficient to accommodate detents 16, and the detents 16 are formed at a location beneath the gas plug bore opening. In such an embodiment, use of a smaller diameter gas plug 40 having the concomitant advantages described above, therefore, necessitated the use of a cam-shaped actuator 45, as shown in FIG. 11B, to house the position selectors 20 that engage the detents 16 when adjusting the gas flow. The cam-shaped position selector 45 has a limited in angular sweep as turning the gas plug 40 beyond a certain angle extends the cam-shaped actuator 45 beyond the radial dimensions of the gas block 2, which then interferes with installed accessories. The limited angular sweep in turn limits gas flow adjustment.

Use of an internal channel 7 centerline A that is offset higher from the gas bore 8 centerline B provides a larger surface area 94 above the muzzle end 90 of the gas plug bore opening that is able to accommodate the formation of detents 16, as shown in FIGS. 5-7. Thus, the detents 16 can be formed around the entire outside surface of the gas plug bore opening, which permits a 360 degree angular sweep for the gas plug 40 without causing the actuator 44 to extend beyond the radial dimensions of the gas block 2. This provides much greater flexibility in adjusting the gas flow without interfering with installed accessories.

Details of the drive rod 70 and bolt carrier assembly 10 are shown in FIG. 1. The system includes a drive rod 70, a biasing means 78, and a bolt carrier assembly 10. A muzzle end of the drive rod 72 defines a hollow sleeve configured to form a piston-cylinder-type coupling with the piston portion 6 of the gas block 2. A breech end 70 of the drive rod 70 is configured to couple with the bolt carrier assembly 10.

An example of a convenient biasing means is a drive rod spring 78. The drive rod spring 78 can be designed such that the drive rod 70 is inserted through the drive rod spring 78, and the spring 78 is compressed between the bolt carrier assembly 10 and an annular shelf 76 optionally formed on the outer circumference of the drive rod 70. The drive rod 70 may also optionally include a stop 73 to limit breechward travel of the rod 70. Optionally, a bushing 79 can be provided to act as a spacer that adjusts the spring force and limits the breechward travel of the drive rod 70. The bushing 79 may also prevent the drive rod 70 from being dislodged from the piston portion 6 in the event of a drive rod spring 78 failure.

Focusing on the path of the discharge gas, a fired round travels in the muzzleward direction as it is propelled by the discharge gas. When the round passes the gas port formed through the barrel, a portion of the discharge gas is directed to the gas plug bore 8 through the gas port and aperture 10. The aperture 10 may be partially covered by the regulator 42 portion of the gas plug 40, thereby adjusting the properties of the discharge gas flow. The discharge gas travels through the gas plug bore 8 and piston portion 6 in the breechward direction and exits the gas block 2 through the exhaust outlet 9.

Upon exiting the exhaust outlet 9, the discharge gas impinges on the bottom of the sleeve defining the muzzle end 72 of the drive rod. The pressure of the discharge gas exerts a force against the bottom of the sleeve and pushes the drive rod 70 in the breechward direction. As the drive rod 70 translates in the breechward direction, the drive rod spring 78 is compressed, and the bolt carrier assembly 10 is also translated in the breechward direction through impingement of the flat surface of the rod 74 on the carrier key 82. The breechward translation of the bolt carrier 10 serves to extract the casing of the spent round and thereafter to chamber the next live round.

After imparting a breechward translation on the drive rod 70, the discharge gas is directed through a gap between the piston portion 6 and the sleeve 72 and finally exits to the atmosphere. In existing systems, without a low-profile gas block or the gas channels 12, discharge gas is reflected back towards the operator, which may result in skin or eye irritation or even long-term health hazards from heavy metals or other contaminants contained in the discharge gas. In the embodiments shown in the attached figures, however, the low-profile gas block with a smaller annular surface 11 and gas channels 12 permit discharged exhaust gas to flow past the gas block 2 in the muzzleward direction without being reflected back towards the operator.

After the exhaust gas has been discharged, the piston-cylinder coupling is depressurized, and the drive rod spring 78 urges the drive rod 70 back in the muzzleward direction. The drive rod 70 is normally biased in the muzzleward direction when no pressure is present in the exhaust piston-cylinder coupling. Upon the resetting of the coupling, the system is prepared to receive the discharge gas of the next round.

Although the foregoing description provides embodiments of the invention by way of example, it is envisioned that other embodiments may perform similar functions and/or achieve similar results. Any and all such equivalent embodiments and examples are within the scope of the present invention.

What is claimed is:

1. A firearm gas regulation system comprising:

(a) a gas block having a breech end, a muzzle end, a first axis extending between the breech end and the muzzle end, an exterior surface, a barrel bore, a gas plug bore, and an aperture that places the barrel bore in fluid communication with the gas plug bore, wherein (i) the gas plug bore extends from a first opening at the muzzle end at least partially through an interior of the gas block along the first axis and the gas plug bore terminates at an exhaust end, (ii) the gas block further comprises one or more detents disposed on the exterior surface of the gas block proximal to the first opening, (iii) the detents are disposed within a counter-bore formed about the first opening, and (iv) the gas plug bore is sized to accommodate a gas plug regulator portion inserted into the first opening, and (b) a gas plug comprising (i) a first end, (ii) a second end opposite the first end, (iii) a second axis extending between the first end and the second end, (iv) an actuator at the first end, (v) a regulator portion at the second end wherein (A) the regulator portion includes a passage that extends from a second opening to a third opening, (B) the second opening includes a first segment having a first segment area and a second segment having a second segment area, (C) when the regulator portion is inserted into the gas plug bore, the second opening is placed in fluid communication with the aperture, (D) the actuator further comprises a circumferential step formed a distance from the first end and sized to be received within the counter-bore when the regulator portion is inserted into the gas plug bore, and (vi) a first position selector residing in the actuator and configured to engage the one or more detents when the regulator portion is inserted into the gas plug bore.

2. The firearm gas regulation system of claim 1, wherein the first segment area is larger than the second segment area.

3. The firearm gas regulation system of claim 1, wherein the first segment has an arcuate shape with a first radius and the second segment has an arcuate shape with a second radius larger than the first radius.

4. The firearm gas regulation system of claim 1, wherein:

(a) the gas plug further comprises a gas plug key disposed between the regulator portion and the actuator, wherein the gas plug key extends from an outer surface of the gas plug in a direction transverse to the second axis;

(b) the gas plug bore comprises (i) a regulator housing cavity at the exhaust end that is sized to accommodate the regulator portion when the gas plug second end is inserted into the first opening, wherein the aperture is disposed within the regulator housing cavity and placed in fluid communication with the second opening, and (ii) a key notch at the muzzle end, wherein (A) the key notch at least partially defines the first opening, and (B) the key notch is sized to accommodate the gas plug key when the gas plug key is inserted into the key notch at a first orientation, (iii) a key channel cavity disposed between the key notch and the regulator housing cavity, wherein the key channel cavity is sized to house the gas plug key and to permit the gas plug key to rotate at least partially about the first axis when the gas plug key is inserted into the first opening and through the key notch.

5. The firearm gas regulation system of claim 4, wherein the gas plug further comprises a ring disposed between the actuator and the key.

6. The firearm gas regulation system of claim 1, wherein the gas plug regulator portion includes a cutout and the third opening is disposed within the cutout.

7. The firearm gas regulation system of claim 1, wherein the gas plug further comprises a second position selector disposed within in the actuator and configured to engage the one or more detents when the regulator portion is inserted into the gas plug bore.

8. The firearm gas regulation system of claim 7, wherein:

(a) the first position selector is housed within a first position selector bore formed in the actuator, and the first position selector is subject to a first biasing means configured to translate the first position selector toward the exhaust end along the second axis; and (b) the second position selector is housed within a second position selector bore formed in the actuator, and the second position selector is subject to a second biasing means configured to translate the second position selector toward the exhaust end along the second axis.

9. The firearm gas regulation system of claim 1, wherein the gas block exterior surface includes at least one channel extending along the first axis from the breech end toward the muzzle end.

10. The firearm gas regulation system of claim 1 further comprising a piston portion extending from the breech end of the gas block along the first axis, wherein the piston portion includes an internal channel in fluid communication with the gas plug bore.

11. A firearm gas regulation system comprising:

(a) a gas block having a breech end, a muzzle end, a first axis extending between the breech end and the muzzle end, an exterior surface, a barrel bore, and one or more detents disposed on the exterior surface proximal to a third opening at the muzzle end, wherein the one or more detents are disposed within a counter-bore formed about the third opening;

(b) a gas plug comprising (i) a first end, (ii) a second end opposite the first end, (iii) a second axis extending between the first end and the second end, (iv) an actuator at the first end, wherein the actuator comprises a circumferential step formed a distance from the first end and sized to be received within the counter-bore, (v) a regulator portion at the second end wherein (A) the regulator portion includes a passage that extends from a first opening to a second opening, (B) the first opening includes a first segment having a first segment area and a second segment having a second segment area; and (vi) a gas plug key disposed between the regulator portion and the actuator, wherein the gas plug key extends from an outer surface of the gas plug in a direction transverse to the second axis; and (c) a gas plug bore that extends from the third opening at the muzzle end at least partially through an interior of the gas block along the first axis and terminates at an exhaust end, wherein the gas plug bore comprises (i) a regulator housing cavity at the exhaust end that is sized to accommodate the regulator portion when the regulator portion is inserted into the gas plug bore, wherein the actuator circumferential step is received within the counter-bore when the regulator portion is inserted into the gas plug bore and housed within the regulator housing cavity, (ii) an aperture disposed within the regulator housing cavity, wherein (A) the aperture places the barrel bore in fluid communication with the gas plug bore, and wherein (B) the aperture is in fluid communication with the gas plug first opening when the regulator portion is inserted into the gas plug bore and the regulator portion is housed within the regulator housing cavity, (iii) a first position selector housed within a first position selector bore formed in the actuator, wherein the first position selector is configured to engage the one or more detents when the regulator portion is housed within the regulator housing cavity (iii) a key notch at the muzzle end, wherein (A) the key notch at least partially defines the third opening, and (B) the key notch is sized to accommodate the gas plug key when the gas plug key is inserted into the key notch at a first orientation, and (iv) a key channel cavity disposed between the key notch and the regulator housing cavity, wherein the key channel cavity is sized to house the gas plug key and to permit the gas plug key to rotate at least partially about the first axis when the gas plug key is inserted into the third opening and through the key notch.

12. The firearm gas regulation system of claim 11, wherein the gas plug further comprises a second position selector disposed housed within a second position selector bore formed in the actuator, wherein the second position selector is configured to engage the one or more detents when the regulator portion is housed within the regulator housing cavity.

13. The firearm gas regulation system of claim 11, wherein the gas block exterior surface includes at least one channel extending along the first axis from the breech end toward the muzzle end.

14. The firearm gas regulation system of claim 11, wherein the gas plug regulator portion includes a cutout and the second opening is disposed within the cutout.

* * * * *